US009501968B2

(12) United States Patent
Lee et al.

(10) Patent No.: US 9,501,968 B2
(45) Date of Patent: Nov. 22, 2016

(54) ORGANIC LIGHT EMITTING DISPLAY DEVICE AND DRIVING METHOD THEREOF

(71) Applicant: Samsung Display Co., Ltd., Yongin, Gyeonggi-Do (KR)

(72) Inventors: Ji-Gong Lee, Yongin (KR); Sang-Jin Pak, Yongin (KR); Jin-Woo Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 455 days.

(21) Appl. No.: 13/971,803

(22) Filed: Aug. 20, 2013

(65) Prior Publication Data

US 2014/0292823 A1 Oct. 2, 2014

(30) Foreign Application Priority Data

Apr. 1, 2013 (KR) ..... 10-2013-0035286

(51) Int. Cl.
*G09G 3/3225* (2016.01)
*G09G 3/32* (2016.01)
*G09G 3/20* (2006.01)

(52) U.S. Cl.
CPC ..... *G09G 3/3225* (2013.01); *G09G 3/2022* (2013.01); *G09G 3/3233* (2013.01); *G09G 2300/0842* (2013.01); *G09G 2320/0276* (2013.01); *G09G 2320/0673* (2013.01); *G09G 2360/16* (2013.01)

(58) Field of Classification Search
CPC ..... G09G 3/3225; G09G 3/2022; G09G 3/3233; G09G 2360/16; G09G 2320/0276; G09G 2320/0673; G09G 2300/0842
See application file for complete search history.

(56) References Cited

U.S. PATENT DOCUMENTS

2006/0033445 A1* 2/2006 Kim ..... G09G 3/3233 315/169.3
2011/0115768 A1* 5/2011 Hara ..... G09G 3/204 345/208

FOREIGN PATENT DOCUMENTS

KR 10-2008-0081644 A 9/2008
KR 10-2009-0109872 A 10/2009
KR 10-2010-0094815 A 8/2010
KR 10-2011-0038496 A 4/2011

* cited by examiner

*Primary Examiner* — Amare Mengistu
*Assistant Examiner* — Sarvesh J Nadkarni
(74) *Attorney, Agent, or Firm* — Lewis Roca Rothgerber Christie LLP

(57) ABSTRACT

An organic light emitting display includes: a display region including: a plurality of data lines, a plurality of scan lines, and a plurality of pixels coupled to corresponding ones of the data lines and corresponding ones of the scan lines; a timing controller configured to: divide input data into frames, select a set of a plurality of subfields having different time-weighted values for a plurality of gray levels of the input data to generate conversion data, and convert the input data into image data based on the conversion data; a scan driver configured to supply a plurality of scan signals to the scan lines; and a data driver configured to generate a plurality of data signals using the image data and to supply the data signals to the data lines.

21 Claims, 6 Drawing Sheets

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2013-0035286, filed in the Korean Intellectual Property Office on Apr. 1, 2013, the entire content of which is incorporated herein by reference.

BACKGROUND

1. Field

Embodiments of the present invention relate to an organic light emitting display and a driving method thereof.

2. Description of the Related Art

Examples of flat panel organic light emitting displays include liquid crystal display (LCD), a field emission display (FED), a plasma display panel (PDP), and an organic light emitting diode (OLED) display.

Among these flat panel displays, an organic light emitting display using an organic light emitting diode (OLED) generally refers to a flat panel display using light emission from organic materials. The OLED emits light by using a mechanism in which electrons and holes are injected from electrodes and the injected electrons and holes are excited and combined together.

Because the organic light emitting display does not require a separate light source, its volume and weight can be reduced relative to other types of displays that may require a separate light source. Also, the organic light emitting display has a relatively fast response speed, is driven with relatively lower power consumption, and has relatively excellent emission efficiency, luminance, and viewing angle. Therefore, the organic light emitting display is used for electronic products such as portable devices or large-size televisions.

The above information disclosed in this Background section is only for enhancement of understanding of the background of the invention and therefore it may contain information that does not form the prior art that is already known in this country to a person of ordinary skill in the art.

SUMMARY

In general, an organic light emitting display compensates for luminance differences in original frame data by using a gamma curve. However, compensation data of about 18 bits is required in order to correctly represent a gamma of 2.2 at low gray level. Due to this, the memory size is increased.

Accordingly, embodiments of the present invention have been made in an effort to provide an organic light emitting display, which is capable of representing a gamma curve without an additional memory in a driving scheme of adjusting luminance in real time, and a driving method thereof.

An embodiment of the present invention provides an organic light emitting display including: a display region including: a plurality of data lines, a plurality of scan lines, and a plurality of pixels coupled to corresponding ones of the data lines and corresponding ones of the scan lines; a timing controller configured to: divide input data into frames, select a set of a plurality of subfields having different time-weighted values for a plurality of gray levels of the input data to generate conversion data, and convert the input data into image data based on the conversion data; a scan driver configured to supply a plurality of scan signals to the scan lines; and a data driver configured to generate a plurality of data signals using the image data and to supply the data signals to the data lines.

The timing controller may include an image processor configured to take a plurality of sample sets respectively corresponding to the plurality of gray levels of the input data using a plurality of seed values corresponding to the time-weighted values, and to select a sample set among the sample sets that corresponds to a preset target luminance value to generate the conversion data.

The target luminance value may be set based on a gamma curve.

The image processor may include: a memory unit configured to store the input data in frames; a sampling unit configured to add the seed values included in each of the plurality of sample sets to calculate a sampled luminance value; and a gamma table setup unit configured to select the sample set if a difference between the luminance value of the sample set and the target luminance value is less than a margin of error, and to store the sample set in a gamma table.

The gamma table setup unit may be configured to select the sample set by selecting whichever one of the sample sets that has a smallest difference between the sampled luminance value and the target luminance value when the difference between the sampled luminance value and the target luminance value for multiple ones of the sample sets is less than the margin of error.

The gamma table setup unit may be configured to compare a previously stored sample set among the sample sets with a currently found sample set among the sample sets each time the difference between the sampled luminance value and the target luminance value for the currently found sample set is less than the margin of error, and to update the gamma table with whichever one, among the previously stored sample set and the currently found sample set, has a smaller difference between the sampled luminance value and the target luminance value.

The gamma table setup unit may be configured to ignore any sample set wherein the difference between the sampled luminance value and the target luminance value is greater than the margin of error, and to search for a new sample set.

The gamma table setup unit may be configured, for each of the sample sets, to add the target luminance value as a seed value when the difference between the sampled luminance value and the target luminance value is greater than the margin of error.

The gamma table setup unit may be configured to separate the plurality of gray levels into a low gray level range for gray levels below a reference gray level and into a high gray level range for gray levels above the reference gray level, and to use different margins of error for the low gray level range and the high gray level range.

The gamma table setup unit may be configured to set the time-weighted value of a lowest gray level as a minimum on-time, and to select a set of subfields such that the time-weighted value linearly increases from the lowest gray level to a certain gray level range.

The image processor may further include a luminance measurement unit configured to receive feedback of luminance values displayed through the display region, wherein the luminance values correspond to the plurality of gray levels.

The gamma table setup unit may be configured to correct the target luminance value based on the feedback luminance values.

Another embodiment of the present invention provides a driving method of an organic light emitting display, the organic light emitting display including: a display region including a plurality of data lines, a plurality of scan lines, and a plurality of pixels coupled to corresponding ones of the data lines and corresponding ones of the scan lines, a timing controller configured to convert input data into image data, a scan driver configured to supply a plurality of scan signals to the plurality of scan lines, and a data driver configured to generate a plurality of data signals using the image data and to supply the plurality of data signals to the plurality of data lines, the method including: dividing the input data into frames; selecting a set of a plurality of subfields having different time-weighted values for a plurality of gray levels of the input data to generate conversion data; and converting the input data into image data based on the conversion data.

The generating of conversion data may include: taking a plurality of sample sets respectively corresponding to the plurality of gray levels of the input data using a plurality of seed values corresponding to the time-weighted values; and selecting a sample set corresponding to a target luminance value from among the plurality of sample sets.

The method may further include setting the target luminance value based on a gamma curve.

The selecting of the sample set may include: adding the seed values included in each of the plurality of sample sets to calculate a sampled luminance value; and storing the sample set as a variable in a gamma table if a difference between the sampled luminance value and the target luminance value for the sample set is less than a margin of error.

The selecting of a sample set may include, if there are multiple ones of the sample sets wherein the difference between the sampled luminance value and the target luminance value is less than the margin of error, selecting whichever one among the multiple ones of the sample sets wherein the difference is smallest.

The selecting of a sample set may include comparing the difference between the sampled luminance value and the target luminance value for a previously stored sample set with the difference between the sample luminance value and the target luminance value for a currently found sample set, and updating the gamma table with whichever one, between the previously stored sample set and the currently found sample set the sample, has the difference that is smaller.

Selecting the sample set may include ignoring any of the sample sets wherein the difference between the sampled luminance value and the target luminance value is greater than the margin of error.

Generating the conversion data may include adding the target luminance value as a seed value if the difference between the sampled luminance value and the target luminance value is greater than the margin of error for each of the sample sets.

The method may further include: separating the plurality of gray levels into a low gray level range for gray levels below a reference gray level and into a high gray level range for gray levels above the reference gray level; and using different margins of error for the low gray level range and the high gray level range.

Selecting the sample set may include: setting the time-weighted value of a lowest gray level as a minimum on-time; and selecting a set of subfields such that the time-weighted value linearly increases from the lowest gray level to a certain gray level range.

The method may further include: receiving feedback of luminance values displayed through the display region that correspond to the plurality of gray levels; and correcting the target luminance value according to the feedback of luminance values.

According to an embodiment of the present invention, the organic light emitting display and the driving method thereof make it possible to correctly or more effectively represent a gamma even at low gray level by selecting an optimal set of seed values to form a gamma curve in a driving scheme of adjusting luminance in real time.

Moreover, according to an embodiment of the present invention, a gamma error can be easily corrected by correcting target luminance according to display panel characteristics.

In addition, according to an embodiment of the present invention, there is no need for an additional memory for gamma correction, and therefore the size of driving ICs is not increased and power consumption and cost can be reduced.

DETAILED DESCRIPTION

Figure 1:
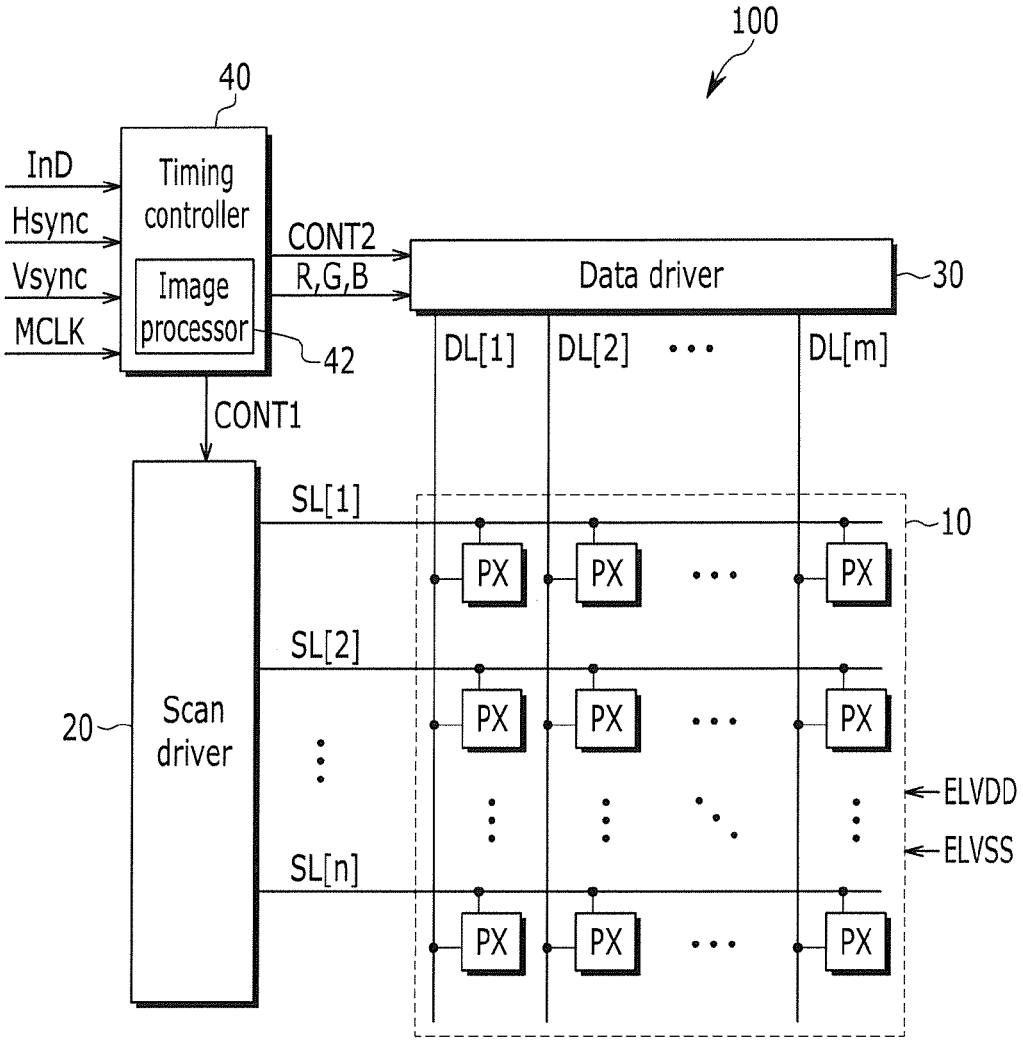
FIG. 1 is a block diagram showing an organic light emitting display in accordance with a first embodiment of the present invention.

In the following detailed description, only certain embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals generally designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising," will be understood to imply the inclusion of stated elements but not the exclusion of any other elements.

Hereinafter, embodiments will be described in some detail with reference to the accompanying drawings such that those skilled in the art can easily carry out the present invention.

Now, an embodiment of the present invention will be described in some detail.

FIG. 1 is a block diagram showing an organic light emitting display in accordance with a first embodiment of the present invention.

Referring to FIG. 1, an organic light emitting display according to a first embodiment of the present invention includes a display region 10, a scan driver 20, a data driver 30, and a timing controller 40.

The display region 10 includes a plurality of pixels PX, a plurality of scan lines SL[1] to SL[n], a plurality of data lines DL[1] to DL[m], and power voltage (ELVDD and ELVSS) supply lines.

Each of the plurality of pixels PX includes a red subpixel emitting red light, a green subpixel emitting green light, and a blue subpixel emitting blue light, and displays images of various colors.

Figure 2:
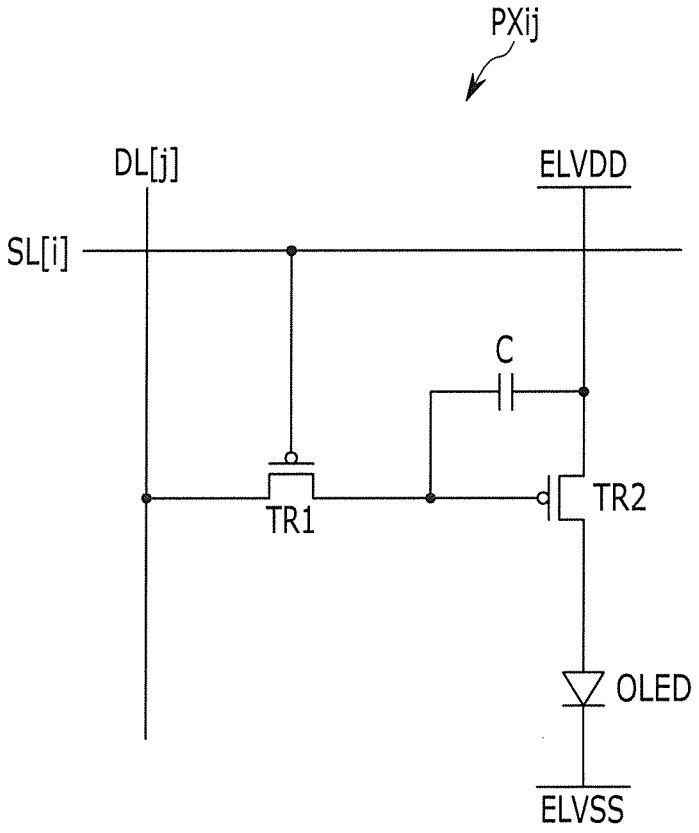
FIG. 2 is a schematic circuit diagram of a pixel PX shown in FIG. 1.

For example, the pixel PXij coupled to the i-th scan line SL[i] and the j-th data line DL[j], among the plurality of pixels PX, includes, as shown in FIG. 2, a switching transistor TR1, a driving transistor TR2, a capacitor C, and an organic light emitting diode OLED.

The switching transistor TR1 includes a gate electrode coupled to the scan line SL[i], a source electrode coupled to the data line DL[j], and a drain electrode coupled to the gate electrode of the driving transistor TR2.

The driving transistor TR2 includes a source electrode coupled to the power voltage (ELVDD) supply line, a drain electrode coupled to the anode of the red organic light emitting diode OLED, and a gate electrode to which a data signal Vdata is transferred during the turn-on period of the switching transistor TR1.

The capacitor C is coupled between the gate electrode and source electrode of the driving transistor TR2. The cathode of the organic light emitting diode is coupled to the power voltage (ELVSS) supply line.

When the switching transistor TR1 of a pixel PX having the above-described configuration is turned on by a scan signal S[i], a data signal Vdata is transferred to the gate electrode of the driving transistor TR2. A voltage difference between the gate and source electrodes of the driving transistor TR2 is maintained by the capacitor C, and a driving current Id flows through the driving transistor TR2. The organic light emitting diode OLED emits light depending on the driving current Id.

An embodiment of the present invention is not limited to the above embodiment, and the pixel PX of FIG. 2 is merely an example of a pixel of a display device and other types of pixels can be used.

Referring again to FIG. 1, the scan driver 20 is coupled to a plurality of scan lines SL[1] to SL[n], and generates a plurality of scan signals S[1] to S[n] in response to a first driving control signal CONT1. The scan driver 20 transfers scan signals S[1] to S[n] to the corresponding scan lines SL[1] to SL[n].

The data driver 30 samples and latches image data R, G, and B in response to a second driving control signal CONT2 to generate a plurality of data signals D[1] to D[m]. The data driver 30 transfers data signals D[1] to D[m] to the corresponding data lines DL[1] to DL[m].

The timing controller 40 receives an external synchronization signal and processes it to generate first and second driving control signals CONT1 and CONT2. The synchronization signal includes a horizontal synchronization signal Hsync, a vertical synchronization signal Vsync, and a main clock signal MCLK.

The timing controller 40 divides externally input data InD into frames, selects at least one subfield respectively corresponding to a plurality of gray levels of the input data InD, among a plurality of subfields having different time-weighted values according to conversion data, and converts input data InD for one frame into the selected subfield to generate image data R, G, and B.

To this end, the timing controller 40 according to one embodiment of the present invention includes an image processor 42. The image processor 42 sequentially stores input data InD in frames, and takes a plurality of sample sets respectively corresponding to a plurality of gray levels of the input data InD by using a plurality of seed values. Then, the image processor 42 selects a sample set corresponding to a predetermined target luminance value from among the taken sample sets to generate conversion data TD.

Figure 3:
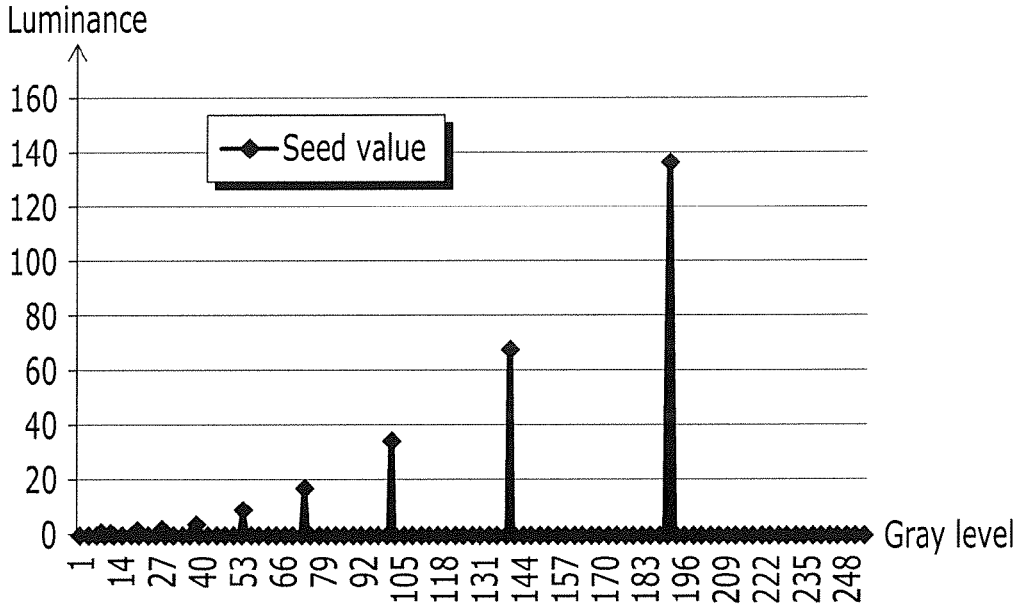
FIG. 3 is a graph illustrated to explain seed values in accordance with an embodiment of the present invention.

The plurality of seed values are pre-stored, along with their indices, in the form of an array, and each of the seed values indicates a time-weighted value corresponding to a specific one of the plurality of gray levels of the input data InD which cannot be represented as a different set of gray levels. For example, as shown in FIG. 3, each seed value may be denoted by a luminance value corresponding to a specific one of the plurality of gray levels.

A seed array A includes a plurality of seed values, and a sample set indicates a set of r elements chosen, regardless of their order, from n different elements respectively corresponding the plurality of seed values. That is, a sample set Cset may be represented by {A, n, r}.

Target luminance denotes a luminance value corresponding to a gamma curve preset according to a gamma characteristic of the display panel. In one embodiment, a target luminance value corresponding to a gamma curve is set for each gray level. While the above description has been made with respect to an example using a gamma of 2.2, the embodiments of the present invention are not limited thereto.

Figure 4:
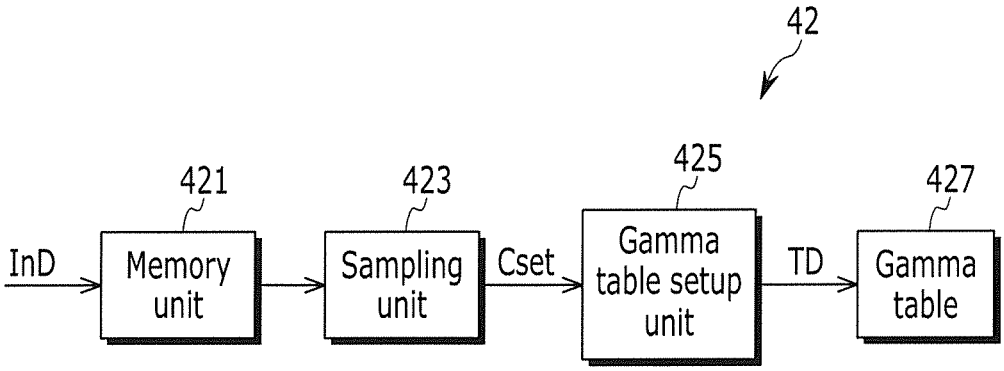
FIG. 4 is a block diagram showing an image processor in accordance with the first embodiment of the present invention.

FIG. 4 is a detailed block diagram showing an image processor 42 according to a first embodiment of the present invention.

Referring to FIG. 4, the image processor in accordance with the first embodiment of the present invention includes a memory unit 421, a sampling unit 423, a gamma table setup unit 425, and a gamma table 427. The memory unit 421 stores input data InD in frames.

The sampling unit 423 takes a plurality of sample sets respectively corresponding to a plurality of gray levels of the input data InD by using a plurality of seed values. The sampling unit 423 adds a plurality of seed values included in each of the plurality of sample sets up to calculate a sampled luminance value.

The gamma table setup unit 425 compares the sampled luminance values with a target luminance value, and selects a sample set corresponding to a sampled luminance value close to the target luminance value, from among the plurality of sample sets. In one embodiment, the gamma table setup unit 425 determines whether or not differences between the sampled luminance values and the target luminance value are within a preset margin of error. The gamma table setup unit 425 searches the plurality of sample sets until it finds any sample set showing a difference less than a preset margin of error between the sampled luminance value and the target luminance value.

If the gamma table setup unit 425 finds one or more sample sets within the preset margin of error, it selects the sample set showing the least or smallest difference between the sampled luminance value and the target luminance value. In one embodiment, the gamma table setup unit 425 temporarily stores a sample set as a variable in the gamma table 427 if the sample set shows a difference less than the margin of error between the sampled luminance value and the target luminance value. Upon finding another sample set showing a difference less than the margin of error between the sampled luminance value and the target luminance value, the gamma table setup unit 425 compares this sample set with the temporarily stored variable, and updates the gamma table 426 according to a comparison result.

Next, the gamma table setup unit 425 generates conversion data using the final selected sample set, and stores the conversion data in the gamma table 427. In one embodiment, the gamma table setup unit 425 sets up the gamma table 427 before shipment of the display panel.

Figure 5:
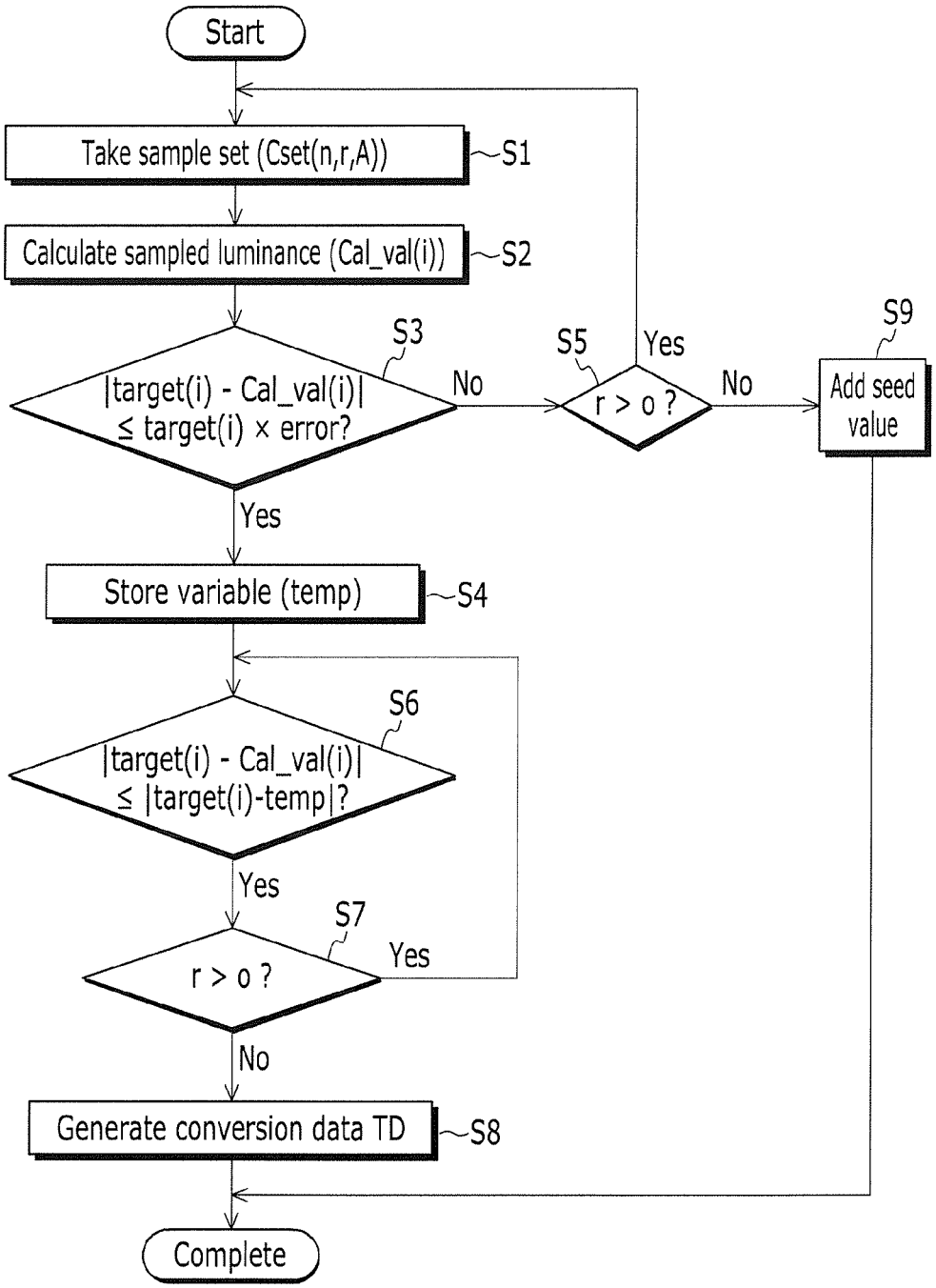
FIG. 5 is a flowchart showing a driving method of an organic light emitting display in accordance with an embodiment of the present invention.

FIG. 5 is a flowchart showing a driving method of an organic light emitting display in accordance with an embodiment of the present invention.

Referring to FIGS. 4 and 5, input data InD in frames is stored in the memory unit 421. The sampling unit 423 selects r seed values from n seed values of a seed array A, and takes a sample set Cset (step S1). Next, the sampling unit 420 adds the selected r seed values to calculate a sampled luminance value (Cal_val(i)) (step S2).

The gamma table setup unit 425 calculates the difference between a target luminance (target(i)) corresponding to the i-th gray level and the sampled luminance value (Cal_val (i)). Next, the gamma table setup unit 425 compares the calculated luminance difference with a margin of error (target(i)*error (%)) (step S3).

If the result shows that the luminance difference is within the margin of error, the gamma table setup unit 425 temporarily stores the sample set Cset corresponding to the sampled luminance value (Cal_val(i)) as a variable (temp) in the gamma table 427 (step S4).

On the contrary, if the result shows that the luminance difference is beyond the margin of error, the gamma table setup unit 425 ignores the sample set Cset, and takes a new sample set Cset by means of the sampling unit 423. In one embodiment, the sampling unit 423 takes sample sets while decreasing the number r one at a time.

Next, the gamma table setup unit 425 performs the step S3 by using the sampled luminance value (Cal_val(i)) corresponding to the new sampled set Cset. If the result of the comparison in step S3 shows that the luminance difference is beyond the margin of error, the gamma table setup unit 425 takes another new sample set Cset by means of the sampling unit 423. By repeating this procedure, the gamma table setup unit 425 continues to search for sample sets Cset showing or having luminance differences less than the margin of error (step S5).

On the contrary, if the result shows that the luminance difference is within the margin of error, the gamma table setup unit 425 determines which of the temporarily stored sample set Cset and the new sample set Cset is closer to the target luminance value (step S6).

That is, the gamma table setup unit 425 compares the difference between the target luminance value (target(i)) and the new sampled luminance value (Cal_val(i)) with the difference between the target luminance value (target(i)) and the variable (temp). If the result shows that the difference between the target luminance value (target(i)) and the new sampled luminance value (Cal_val(i)) is less than the difference between the target luminance value (target(i)) and the variable (temp), the gamma table setup unit 425 updates the new sampled luminance value Cal_val(i) as a new variable (temp).

By repeating this procedure, the gamma table setup unit 425 determines whether r=0, that is, the sample sets Cset for all of the n seed values have been searched (step S7). After completion of determination, conversion data TD is generated using the final sample set Cset stored as a variable (temp), and stored in the gamma table 427 (step S8).

Meanwhile, the gamma table setup unit 425 determines whether the sample sets Cset for all of the n seed values have been searched in step S5. After completion of determination, if no sample set Cset is found which shows a luminance difference less than the margin of error, the target luminance value (target(i)) is added as a new seed value (step S9).

The gamma table setup unit 425 performs the above procedure on all of the gray levels of the input data InD to set up the gamma table 427.

Embodiments of the present invention are not limited to the above-described embodiment, and the gamma table setup unit 425 may omit some of the sample sets Cset for all of the n seed values, rather than searching all of them. In one embodiment, the seed values are aligned or arranged in descending order and the gamma table setup unit 425 can take the sample sets Cset while decreasing the number r one at a time. At that time, the gamma table setup unit 425 may stop searching the next sample set Cset when the sampled luminance value (Cal_val(i)) becomes smaller than the target luminance value and the difference is beyond the margin of error.

In another embodiment, the seed values are aligned or arranged in ascending order and the gamma table setup unit 425 can take the sample sets Cset while decreasing the number r one at a time. At that time, the gamma table setup unit 425 may stop searching the next sample set Cset when the luminance value obtained by adding some elements of a sample set Cset becomes greater than the target luminance value (target(i)) and the difference is beyond the margin of error. That is, higher operation speed and lower power consumption are achieved by omitting unnecessary operations.

In one embodiment, the gamma table setup unit 425 may divide a plurality of gray levels in a low gray level area for gray levels below a reference gray level and a high gray level area for gray levels above the reference gray level, and use different margins of error for the low gray level area and the high gray level area. For example, a margin of error of 5% may be used for gray levels below gray level 32, and a margin of error of 1% may be used for gray levels below gray level 32.

In another embodiment, the gamma table setup unit 425 may set the seed value corresponding to the lowest gray level as the minimum on-time for driving, and set the conversion data using a sampled luminance value that linearly increases from the lowest gray level to a certain gray level range.

In general, it takes about 16.7 seconds to represent image data (R, G, B) with 255 gray levels. Thus, on time of approximately 80 ns is required to represent image data (R, G, B) with 1 gray level. However, in one embodiment, if the driving speed of the display panel in the low gray level area does not match up to this on time, the gamma table setup unit 425 may change (e.g., arbitrarily change) the on time for the low gray level area, thereby improving drive margin. Also, the driving voltage, as well as the on time for the low gray level area, may be changed, or the organic light emitting diode OLED may be divided into n parts in terms of design, thereby improving drive margin.

In another embodiment, the gamma table setup unit 425 may set up a plurality of gamma tables 427 by using a plurality of sample sets Cst within a margin of error, considering power consumption or dynamic false contour (DFC).

Figure 6:
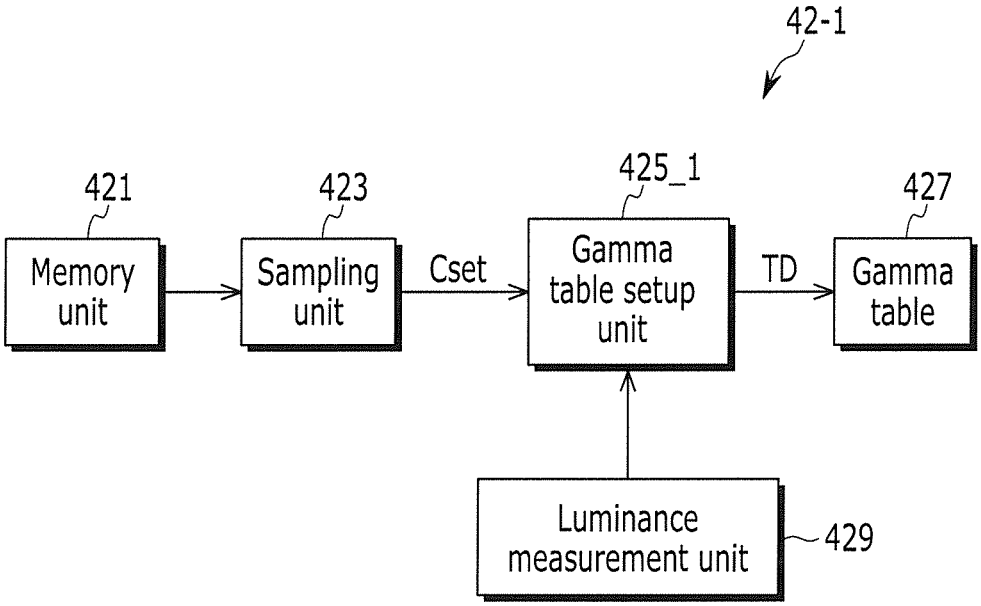
FIG. 6 is a block diagram showing an image processor in accordance with a second embodiment of the present invention.

FIG. 6 is a block diagram showing an image processor 42_1 in accordance with a second embodiment of the present invention.

Referring to FIG. 6, the image processor 42-1 in accordance with a second embodiment of the present invention includes a memory unit 421, a sampling unit 423, a gamma table setup unit 425_1, a gamma table 427, and a luminance measurement unit 429. The memory unit 421, the sampling unit 423, and the gamma table 427 have the same or similar configurations as those of FIG. 4, and a detailed description thereof will be omitted.

The luminance measurement unit 429 displays an image corresponding to image data (R, G, B) on the display region 10 in the order of gray levels according to conversion data. The luminance measurement unit 429 measures the luminance values for each gray level, and gives measurement feedback to a gamma table setup unit 425_1. Luminance can be measured in various ways, for example, by a luminance meter.

The gamma table setup unit 425_1 calculates a corrected target luminance value by using the differences between the feedback luminance values and a target luminance value, and updates the conversion data based on the corrected target luminance.

According to the second embodiment of the present invention, it can use a single gamma curve, without the use of a plurality gamma curves corresponding to the different characteristics, because different characteristics of display panels are reflected on corrected target luminance.

While embodiments of the present invention have been described in connection with what is presently considered to be practical embodiments, it is to be understood that the invention is not limited to the disclosed embodiments, but, on the contrary, is intended to cover various modifications and equivalent arrangements included within the spirit and scope of the appended claims, and their equivalents.

DESCRIPTION OF SOME OF THE REFERENCE NUMERALS

10: display region
20: scan driver
30: data driver
40: timing controller

What is claimed is:

1. An organic light emitting display comprising:
a display region comprising:
a plurality of data lines,
a plurality of scan lines, and
a plurality of pixels coupled to corresponding ones of the data lines and corresponding ones of the scan lines;
a timing controller configured to:
divide input data into frames,
select a set of a plurality of subfields having different time-weighted values for a plurality of gray levels of the input data to generate conversion data, and
convert the input data into image data based on the conversion data;
a scan driver configured to supply a plurality of scan signals to the scan lines; and
a data driver configured to generate a plurality of data signals using the image data and to supply the data signals to the data lines,
wherein the timing controller comprises an image processor configured to take a plurality of sample sets respectively corresponding to the plurality of gray levels of the input data using a plurality of seed values corresponding to the time-weighted values, and select a sample set from among the plurality of sample sets that corresponds to a preset target luminance value to generate the conversion data.

2. The organic light emitting display of claim 1, wherein the target luminance value is set based on a gamma curve.

3. The organic light emitting display of claim 1, wherein the image processor comprises:
a memory configured to store the input data in frames;
a sampler configured to add the seed values included in each of the plurality of sample sets to calculate a sampled luminance value; and
wherein the image processor is configured to select the sample set if a difference between the luminance value of the sample set and the target luminance value is less than a margin of error, and to store the sample set in a gamma table.

4. The organic light emitting display of claim 3, wherein the image processor is further configured to select the sample set by selecting whichever one of the sample sets that has a smallest difference between the sampled luminance value and the target luminance value when the difference between the sampled luminance value and the target luminance value for multiple ones of the sample sets is less than the margin of error.

5. The organic light emitting display of claim 4, wherein the image processor is further configured to compare a previously stored sample set among the sample sets with a currently found sample set among the sample sets each time the difference between the sampled luminance value and the target luminance value for the currently found sample set is less than the margin of error, and to update the gamma table with whichever one, among the previously stored sample set and the currently found sample set, has a smaller difference between the sampled luminance value and the target luminance value.

6. The organic light emitting display of claim 3, wherein the image processor is further configured to ignore any sample set wherein the difference between the sampled luminance value and the target luminance value is greater than the margin of error, and to search for a new sample set.

7. The organic light emitting display of claim 3, wherein the image processor is further configured, for each of the sample sets, to add the target luminance value as a seed value when the difference between the sampled luminance value and the target luminance value is greater than the margin of error.

8. The organic light emitting display of claim 3, wherein the image processor is further configured to separate the plurality of gray levels into a low gray level range for gray levels below a reference gray level and into a high gray level range for gray levels above the reference gray level, and to use different margins of error for the low gray level range and the high gray level range.

9. The organic light emitting display of claim 3, wherein the image processor is further configured to set the time-weighted value of a lowest gray level as a minimum on-time, and to select a set of subfields such that the time-weighted value linearly increases from the lowest gray level to a certain gray level range.

10. The organic light emitting display of claim 3, wherein the image processor is further configured to receive feedback of luminance values displayed through the display region, wherein the luminance values correspond to the plurality of gray levels.

11. The organic light emitting display of claim 10, wherein the image processor is configured to correct the target luminance value based on the feedback luminance values.

12. A driving method of an organic light emitting display, the organic light emitting display comprising:

a display region comprising a plurality of data lines, a plurality of scan lines, and a plurality of pixels coupled to corresponding ones of the data lines and corresponding ones of the scan lines, a timing controller configured to convert input data into image data, a scan driver configured to supply a plurality of scan signals to the plurality of scan lines, and a data driver configured to generate a plurality of data signals using the image data and to supply the plurality of data signals to the plurality of data lines, the method comprising:

dividing the input data into frames;

selecting a set of a plurality of subfields having different time-weighted values for a plurality of gray levels of the input data, taking a plurality of sample sets respectively corresponding to the plurality of gray levels of the input data using a plurality of seed values corresponding to the time-weighted values, and selecting a sample set corresponding to a target luminance value from among the plurality of sample sets to generate conversion data; and converting the input data into image data based on the conversion data.

13. The method of claim 12, further comprising setting the target luminance value based on a gamma curve.

14. The method of claim 12, wherein selecting the sample set comprises:

adding the seed values included in each of the plurality of sample sets to calculate a sampled luminance value; and storing the sample set as a variable in a gamma table if a difference between the sampled luminance value and the target luminance value for the sample set is less than a margin of error.

15. The method of claim 14, wherein selecting the sample set further comprises, if there are multiple ones of the sample sets wherein the difference between the sampled luminance value and the target luminance value is less than the margin of error, selecting whichever one among the multiple ones of the sample sets wherein the difference is smallest.

16. The method of claim 14, wherein selecting the sample set further comprises comparing the difference between the sampled luminance value and the target luminance value for a previously stored sample set with the difference between the sample luminance value and the target luminance value for a currently found sample set, and updating the gamma table with whichever one, between the previously stored sample set and the currently found sample set the sample, has the difference that is smaller.

17. The method of claim 14, wherein selecting the sample set further comprises ignoring any of the sample sets wherein the difference between the sampled luminance value and the target luminance value is greater than the margin of error.

18. The method of claim 14, wherein generating the conversion data comprises adding the target luminance value as a seed value if the difference between the sampled luminance value and the target luminance value is greater than the margin of error for each of the sample sets.

19. The method of claim 14, further comprising:

separating the plurality of gray levels into a low gray level range for gray levels below a reference gray level and into a high gray level range for gray levels above the reference gray level; and using different margins of error for the low gray level range and the high gray level range.

20. The method of claim 12, wherein selecting the sample set comprises:

setting the time-weighted value of a lowest gray level as a minimum on-time; and selecting a set of subfields such that the time-weighted value linearly increases from the lowest gray level to a certain gray level range.

21. The method of claim 12, further comprising:

receiving feedback of luminance values displayed through the display region that correspond to the plurality of gray levels; and correcting the target luminance value according to the feedback of luminance values.

* * * * *